US011557853B2

(12) United States Patent
Fabre et al.

(10) Patent No.: US 11,557,853 B2
(45) Date of Patent: Jan. 17, 2023

(54) CONNECTOR ASSEMBLY WITH STRAIN RELIEF DEVICE IN TWO PARTS

(71) Applicant: APTIV TECHNOLOGIES LIMITED, St. Michael (BB)

(72) Inventors: Jean Fabre, Chartres (FR); Pascal Menard, Villepreux (FR)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/501,184

(22) Filed: Oct. 14, 2021

(65) Prior Publication Data

US 2022/0123500 A1 Apr. 21, 2022

(30) Foreign Application Priority Data

Oct. 20, 2020 (EP) ..... 20315436

(51) Int. Cl.
*H01R 13/58* (2006.01)
*H01R 43/26* (2006.01)
*H01R 13/639* (2006.01)

(52) U.S. Cl.
CPC ..... *H01R 13/5812* (2013.01); *H01R 13/639* (2013.01); *H01R 43/26* (2013.01); *H01R 2201/26* (2013.01)

(58) Field of Classification Search
CPC ..... H01R 13/5812; H01R 2201/26; H01R 13/639; H01R 43/26; H01R 13/58; H01R 13/5804
See application file for complete search history.

(56) References Cited

U.S. PATENT DOCUMENTS 5,653,609 A 8/1997 Orstad et al.
6,783,386 B2 8/2004 Clement
(Continued)

FOREIGN PATENT DOCUMENTS

BE 1026750 A1 6/2020
DE 102016122798 A1 5/2018
(Continued)

OTHER PUBLICATIONS

European Search Report for European Application No. 20315436.4 dated Mar. 19, 2021.

*Primary Examiner* — Travis S Chambers
(74) *Attorney, Agent, or Firm* — Carlson, Gaskey & Olds, P.C.

(57) ABSTRACT

Connector assembly comprising a housing and a strain-relief device attached to the housing for clamping a cable in a fixed position at the rear opening of the housing. The strain-relief device comprises first and second portions, both made of a single part and being detachable from the housing. The first portion has a first arcuate surface engaging the outer sheath of the cable, and the first portion also comprising first retaining means engaging the housing for retaining the first portion on the housing. The second portion has a second arcuate surface also engaging the outer sheath, and the second portion also comprising second retaining means engaging the housing for retaining the second portion on the housing. Strain-relief device designed to be mounted on a connector. Method for mounting the strain-relief device with a connector assembly.

11 Claims, 3 Drawing Sheets

(56) References Cited

U.S. PATENT DOCUMENTS

| | | | | |
|---|---|---|---|---|
| 7,476,120 | B2 * | 1/2009 | Patel | H01R 13/5812 439/460 |
| 10,573,988 | B2 * | 2/2020 | Mellott | H01R 13/5219 |
| 10,644,437 | B1 * | 5/2020 | Campos | H01R 13/5221 |

FOREIGN PATENT DOCUMENTS

| | | | |
|---|---|---|---|
| EP | 0509024 | B1 | 10/1992 |
| EP | 0744088 | B1 | 1/1999 |
| EP | 1312137 | B1 | 5/2005 |
| EP | 1808629 | A2 | 7/2007 |

* cited by examiner

CONNECTOR ASSEMBLY WITH STRAIN RELIEF DEVICE IN TWO PARTS

CROSS-REFERENCE TO RELATED APPLICATIONS

This application claims priority to European Patent Application No. EP20315436.4 filed on Oct. 20, 2020.

TECHNICAL FIELD OF THE INVENTION

The invention relates to the field of electrical connectors, for example electrical power connectors and, in particular, electrical power connectors for electric or hybrid motor vehicles.

BACKGROUND OF THE INVENTION

Electrical power connectors are used in electric or hybrid motor vehicles, for example in order to connect a set of batteries to an electric motor, to a power converter, or any HV auxiliary device, etc.

Automotive vehicles and their components are susceptible to vibrations that are transmitted to the power cables and therefore also to the connectors and contacts thereof. Because the section of the power cables is relatively large (for example 40 or 50 $mm^2$), said cables are rigid and have a significant inertia. The level of these vibrations can reach 15 G, 25 G or 40 G depending on where the cables and the connectors are located, and in which type of vehicles they are used (for example high level of vibrations can be generated by combustion engines of hybrid vehicles). With such levels of vibration, the points of electrical contact between the electrical terminals of the connectors can become worn prematurely. This results in a risk of heating and even fire. It is therefore important to prevent this risk.

Cable strain-relief devices exist for fixing and clamping a cable on a connector. However, the existing strain-relief devices impose constraints on the connector assembly process. For example, they may require passing the cable(s) through the strain relief device before connecting each cable to a respective terminal and inserting the terminal and the end of the cable connected to this terminal into the connector housing.

The present disclosure proposes to mitigate at least partially drawbacks of strain-relief devices of the prior art.

BRIEF SUMMARY OF THE DISCLOSURE

The present disclosure proposes a connector assembly The strain-relief device hereby disclosed is made of two parts (a first and a second portions) that can be each mounted from an opposite of a cable. Therefore, such a strain-relief device can be mounted on the connector so that these two parts clamp the cable, even if the terminal electrically and mechanically linked to this cable is already accommodated in a cavity of the housing. The design of such a strain-relief device allows for a mounting from opposite directions (e.g. from the above and from below a couple of big wires) and, for an automatic assembly by a machine. Further, these two parts are directly mounted on the housing (as opposed for example to a strain-relief device having a first part attached to the housing and a part only attached to the first part, and not to the housing). This makes this strain-relief device quite robust and efficient in tightly maintaining the cable.

Other features and advantages of the disclosed connector assembly, considered independently of each other or in combination of one or several others.

BRIEF DESCRIPTION OF THE SEVERAL VIEWS OF THE DRAWING

Further features of the disclosure will become clear by reading the following detailed description and studying the accompanying drawings, in which.

DETAILED DESCRIPTION

Figure 1:
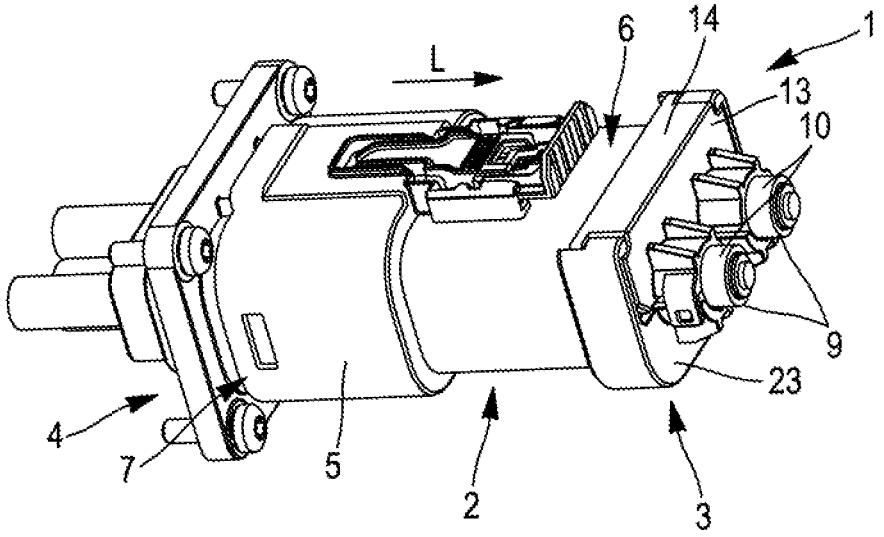
FIG. 1 schematically shows a perspective view of a connector assembly comprising a strain-relief device, according to a first exemplary embodiment of the present disclosure.

A connector assembly 1 is illustrated in FIG. 1, according to a first exemplary embodiment of the present disclosure. The connector assembly 1 comprises a wire connector 2, a strain-relief device 3 mounted on the wire connector 2 and a counterpart-connector 4 (for example, a header) mated to the wire connector 2. The wire connector 2 comprises a housing 5 with two cavities, each one of which accommodates one terminal (for example, one female terminal non-shown). Of course, the below disclosure of a connector assembly comprising a cable connector 2 with two terminals can be easily transposed to cable connectors accommodating only one terminal or accommodating more than two terminals.

Figure 2:
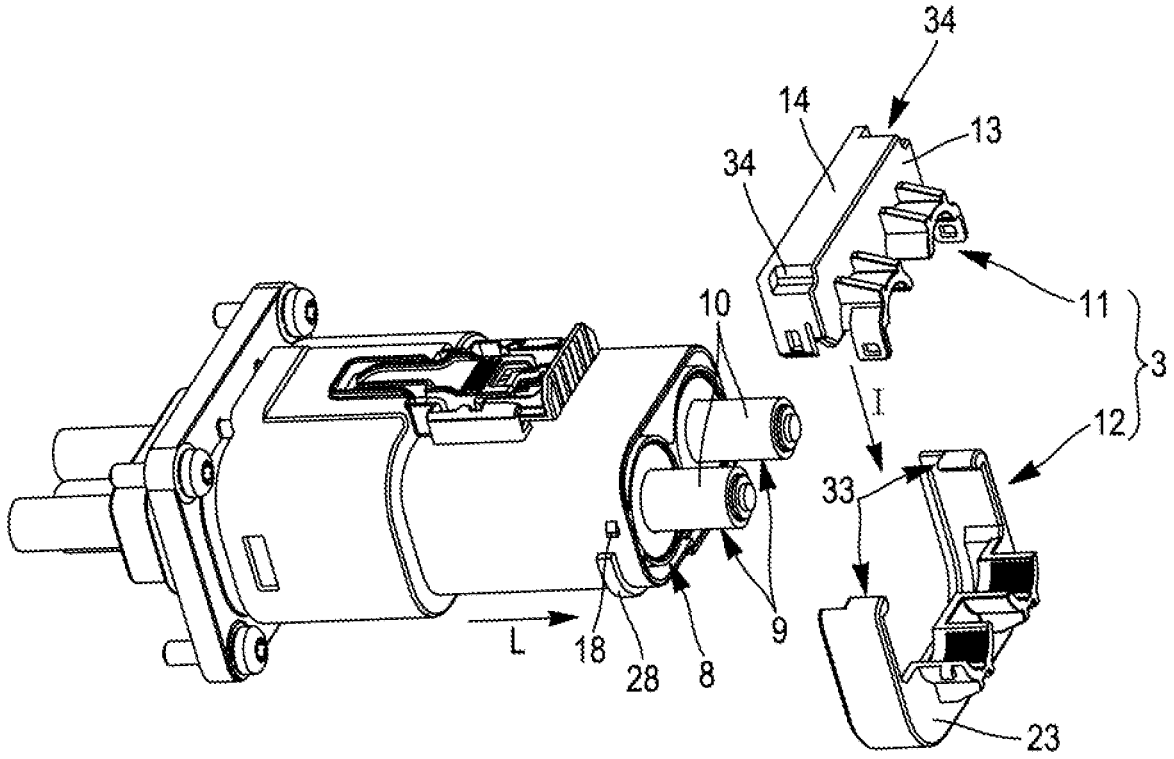
FIG. 2 schematically shows a perspective view of the connector assembly of FIG. 1, with an exploded view of the strain-relief device.

The housing 5 may comprise several parts, one of which is an outer casing 6 made of dielectric plastics. The outer casing 6 extends between a mating face 7, defining a front opening through which the counterpart connector 4 is mated to the connector 2, and a rear opening 8 (see, FIG. 2). Each terminal is electrically and mechanically linked (for example, by crimping or ultrasonic welding) to a cable 9. Each cable 9 extends along a longitudinal direction L (in this document, the longitudinal direction L corresponds to the straight direction of a cable 9 at least along its portion located inside the housing 5; outside the housing 5 a cable 9 may be bent and the direction of its longitudinal axis may vary). Each cable 9 exits from the housing 5 through the rear opening 8. Each cable 9 comprises a conductive core and an outer insulative sheath 10 (optionally, the cable 9 comprises a braid insulated from the conductive core by an inner insulative sheath, the outer insulative sheath 10 surrounding the braid). The cables 9 and the terminals are designed to conduct high-intensity currents. For example, the cross-section of such cables 9 may be in a range of 2 to 50 square millimetres. Consequently, such cables 9 may be quite rigid and the strain-relief device 3 must be robust enough, not only in order to limit the propagation of vibrations from the cables 9 to the terminals, but also to withstand stresses imposed by the cables 9 when the latter are bent.

The strain-relief device 3 comprises a first portion 11 and a second portion 12 made of plastics. The first portion 11 and the second portion 12 are separable from one another. Each of the first portion 11 and the second portion 12 comprises an integrally formed unitary element. Further the first portion 11 and the second portion 12 are detachable from the housing 5. In other words, they are removably mountable on the housing 5.

Figure 3:
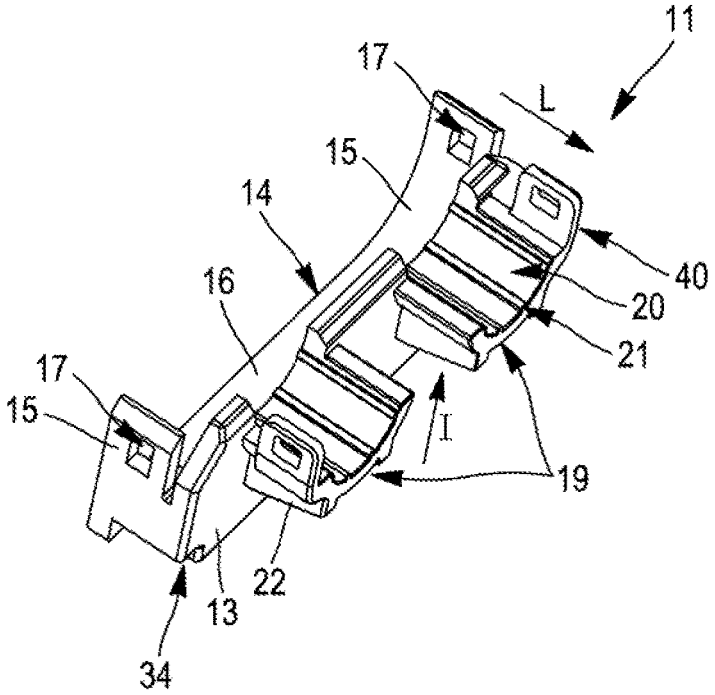
FIG. 3 schematically shows a perspective view of a first portion of the strain-relief device of the connector assembly of FIGS. 1 and 2.

The first portion 11 comprises a first transversal wall 13 that partially closes the rear opening 8. The first transversal wall 13 is essentially perpendicular to the cable longitudinal direction L, when the first portion 11 is mounted on the housing 5. From a rear face of the first transversal wall 13, essentially parallel to the longitudinal direction L, extends a first collar 14 (see, FIG. 3). The first collar 14 is designed to be placed against the surface of the outer casing 6, on the edge of the rear opening 8. The first collar 14 covers about half of the circumference of the rear opening 8. The first collar 14 has a U-shape with two first side portions 15, and a first central portion 16 between the first side portions 15. Each one of the two first side portions 15 forms a flexible branch extending essentially along an insertion direction I, from the first central portion 16 to a free end. First retaining means 17 are located close to each free end. In the illustrated example, the first retaining means 17 is a notch formed by an opening in each first side portion 15. As explained below, each first retaining means 17 is designed for cooperating with first complementary retaining means 18, such as a tooth, formed on the housing 5 (see, FIG. 2).

From a front face of the first transversal wall 13, essentially parallel to the longitudinal direction L, extends two first gutters 19. Each first gutter 19 comprises a first arcuate surface 20 designed to be placed against the outer insulative sheath 10 of a cable 9. For example, the first arcuate surface 20 extends over an angle of about 180° around the longitudinal axis of a cable 9. Consequently, the first arcuate surface 20 leaves a first opening extending over an angle of about 180° around the longitudinal axis of a cable 9. The first opening allows the insertion of a cable 9 in the strain-relief device 3 along the insertion direction I. The angle over which the first arcuate surface 20 extends may differ from 180°, in any case, the sum of the angle corresponding to the first arcuate surface 20 and the angle corresponding to the first opening shall be equal to 360°. First ridges 21 may protrude on the first arcuate surface 20 for strengthening the cable retention. Each first gutter 19 may be strengthened by first stiffeners 22 extending between the front face of the first transversal wall 13 and a first gutter 19. Each first gutter 19 comprises a locking tab 40. Each locking tab 40 extends essentially along the insertion direction I, from one of the longitudinal edges of the first gutters 19. The locking tabs 40 of two adjacent first gutters 19 are opposed to each other relative to these first gutters 19, i.e., they are located on respective outer edge of the first gutters 19, distant from each other. A notch formed by an opening is formed in each locking tab 40. As explained below, each locking tab 40 is designed for cooperating with a complementary protrusion 41 formed on second gutters 29 (See, FIG. 4).

Figure 4:
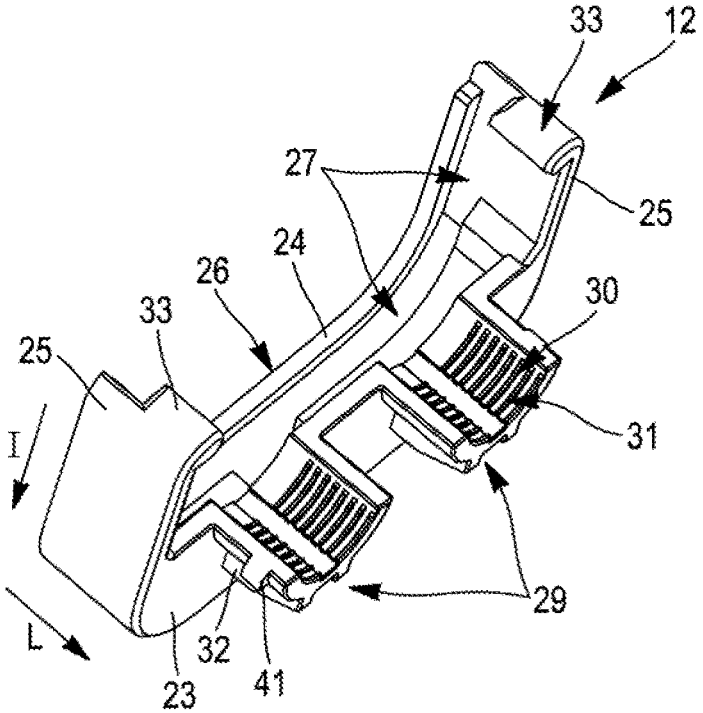
FIG. 4. schematically shows a perspective view of a second portion of the strain-relief device of the connector assembly of FIGS. 1 and 2.

As illustrated by FIG. 4, the second portion 12 comprises a second transversal wall 23 that partially closes the rear opening 8. The second transversal wall 23 is essentially perpendicular to the cable longitudinal direction L, when the second portion 12 is mounted on the housing 5. From a rear face of the second transversal wall 23, essentially parallel to the longitudinal direction L, extends a second collar 24. The second collar 24 is designed to be placed against the surface of the outer casing 6, on the edge of the rear opening 8. The second collar 24 has a U-shape with two second side portions 25, and a second central portion 26 between the second side portions 25. Each one of the two second side portions 25 forms a flexible branch extending essentially along an insertion direction I, from the second central portion 26 to a free end. The second collar 24 extends over more than half of the circumference of the rear opening 8, so that the second side portions 25 cover at least partially the first side portions 15. The second collar 24 comprises second retaining means 27. In the illustrated example, the second retaining means 27 are formed as a groove, designed for engaging second complementary retaining means 28, such as a rib extending along a portion of the edge of the rear opening 8. The cooperation of the second retaining means 27 with the second complementary retaining means 28 limits the displacement of the second portion 12 of the strain-relief device 3 along the longitudinal direction L.

The second portion 12 also comprises locking means 33 for locking both the first portion 11 and the second portion 12 on the housing 5. The locking means 33 are located close to each free end of the second side portions 25. The locking means 33 are located on a side of the groove forming the second retaining means 27. The combination of the second retaining means 27, the second complementary retaining means 28 and 33 the locking means 33 provides a self-guiding effect, useful during an automatic assembly process (such an assembly can be performed along only one direction). In the illustrated example, the locking means 33 is a hook formed at the free end of each second side portion 25. As explained below, each hook of the locking means 33 has a convex surface designed for cooperating with complementary locking means 34, such as a concave surface, formed on the first portion 11 of the strain-relief device 3. The concave surface and the convex surfaces are oriented relatively to the insertion direction, so as to prevent the removal of first 11 and second 12 portions in a direction parallel to the insertion direction I.

From a front face of the second transversal wall 23, essentially parallel to the longitudinal direction L, extends two second gutters 29. Each second gutter 29 comprises a second arcuate surface 30 designed to be placed against the outer insulative sheath 10 of a cable 9. For example, the second arcuate surface 30 extends over an angle of about 180° around the longitudinal axis L of a cable 9. Consequently, the second arcuate surface 30 leaves a second opening extending over an angle of about 180° around the longitudinal axis L of a cable 9. The second opening allows the insertion of a cable 9 in the strain-relief device parallel to the insertion direction I. The angle over which the second arcuate surface 30 extends may differ from 180°, in any case, the sum of the angle corresponding to the second arcuate surface and the angle corresponding to the second opening shall be equal to 360°, and the sum of the angle corresponding to the first arcuate surface 20 and the angle corresponding to the second arcuate surface 30 is advantageously equal or close to 360°. Second ridges 31 may protrude on the second arcuate surface 30 for strengthening the cable retention. Each second gutter 29 may be strengthened by second stiffeners 32 extending between the front face of the second transversal wall 23 and a second gutter 29.

Each second gutter 29 comprises a protrusion 41. Each protrusion 41 protrudes from one of the longitudinal edges of the second gutters 19. The protrusions 41 of two adjacent second gutters 29 are opposed to each other relative to these second gutters 29, i.e., they are located on respective outer edge of the second gutters 29, distant from each other.

The process for assembling the connector 2 comprises operations resulting in the fixation of cables 9 to respective terminals, as well as the positioning and the fixation of terminals in cavities of the housing 5. Subsequently to these operations, the first portion 11 of the strain-relief device 3 is mounted at the rear side of the housing 5. To do so, the first portion 11 is moved in the insertion direction I up to the abutment of the first collar 14 on the surface of the outer casing 6, on the edge of the rear opening 8. In this position, the notch of the first retaining means 17 engages the tooth of the first complementary retaining means 18. The first portion 11 of the strain-relief device 3 is then retained on the housing 5 with the cables 9 received respectively in the first gutters 19. Subsequently, the second portion 12 of the strain-relief device 3 is mounted at the rear side of the housing 5. To do so, the second portion 12 is moved parallel to the insertion direction I up to the abutment of the second collar 24 on the surface of the outer casing, on the edge of the rear opening 8. The groove of the second retaining means 27 and the rib of the second complementary retaining means 28 cooperates for guiding, in the insertion direction I, the positioning of second portion 12 onto the housing 5 (which is convenient for automatic assembly process). Then, the notches of each locking tab 40 engages respectively a complementary protrusion 41 so as to attach each first gutter 19 with a second gutter 29. Each hook of the locking means 33 engages the concave surface of a complementary locking means 34, on the first portion 11 of the strain-relief device 3. The second portion 12 of the strain-relief device 3 is then retained on both the housing 5 and the first portion 11 of the strain-relief device 3 with the cables 9 received respectively between the first gutters 19 and the second gutters 29. The use of first 11 and second 12 portions with gutters 19, 29 that each do not circle completely each cable 9 has the advantage that they can be designed so as to tightly compress the outer insulative sheath 10 of the cables 9. Contrarily, in strain-relief devices of the prior art, a gap is left between the strain-relief device and the outer insulative sheath so as to keep possible and easy the insertion of a cable through the corresponding transversal wall. This improves the sealing performances of such strain-relief devices. The first arcuate surface 20 and the second arcuate surface 30 engage the outer insulative sheath 10 of the cables 9 overall or almost all their respective circumference. The second side portions 25 cover the first retaining means 17 and the first complementary retaining means 18. In other words, the first retaining means 17 and the first complementary retaining means 18 have a primary locking function and the locking means 33 and the complementary locking means 34 have a secondary locking function, strengthening the robustness of the strain-relief device 3.

For removing the first portion 11 and the second portion 12 of the strain-relief device 3 from the housing 5, the second side portions 25 are spaced apart so as to disengage the hooks of the locking means 33 from the concave surfaces of the complementary locking means 34. The locking tabs 40 are also freed from the complementary protrusions 41. Then the second portion 12 can be freely removed. Subsequently, the first side portions 15 are spaced apart so as to disengage the first retaining means 17 from the first complementary retaining means 18. Then the first portion 11 can be freely removed.

Figure 5:
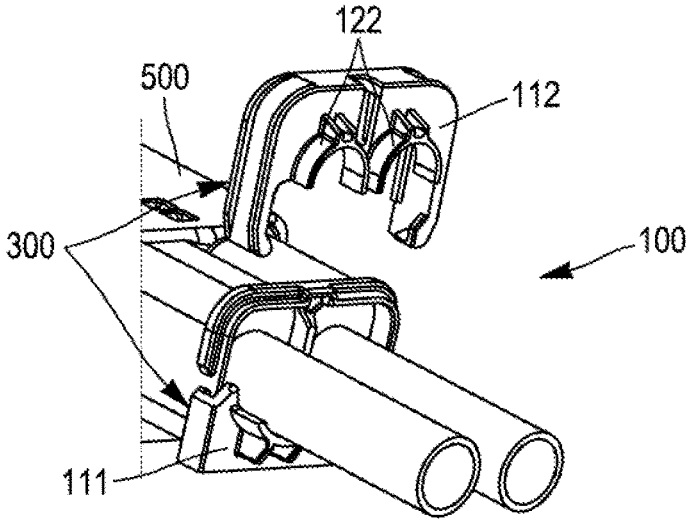
FIG. 5 schematically shows a perspective view of a connector assembly comprising a different strain-relief device, partially mounted on the connector assembly, according to a second exemplary embodiment of the present disclosure.
Figure 6:
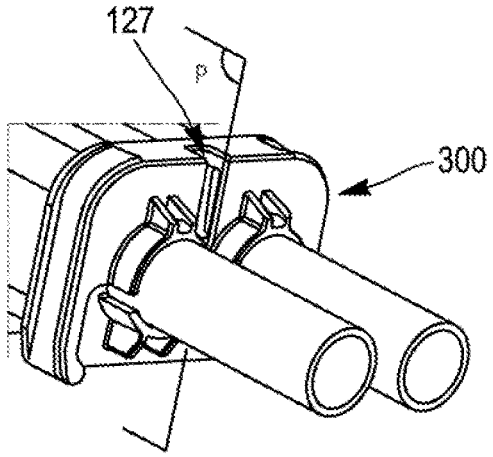
FIG. 6 schematically shows a perspective view of the connector assembly of FIG. 5, with the strain-relief device being mounted on the connector assembly.
Figure 7:
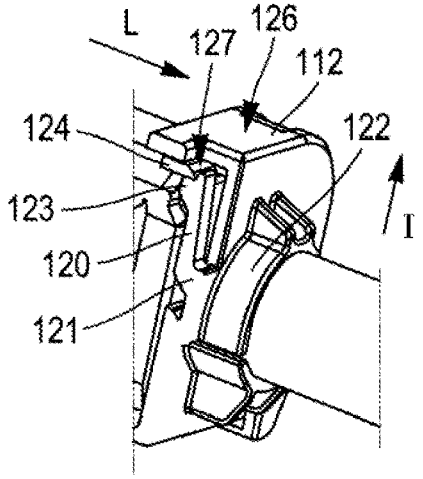
FIG. 7 schematically shows a cross section of the connector assembly of FIG. 6, in a plane P.

FIGS. 5 to 7 schematically illustrate a connector assembly 100 comprising a different strain-relief device 300, partially mounted on the connector assembly 100, according to a second exemplary embodiment of the present disclosure.

This second embodiment differs from the first embodiment essentially by the manner a first portion 111 and a second portion 112 of the strain-relief device 300 are retained and locked on a housing 500. The description of the features which are common to both embodiments are not repeated for the sake of conciseness. In the second embodiment, the second portion 112 of the strain-relief device 300, comprises a flexible locking leg 120 extending longitudinally along the insertion direction I, between a hinge 121 located essentially between second gutters 122, and a free end having a hook 123 engaging a tab 124 protruding from the outer casing of the housing 500, in the longitudinal direction L. The hook 123 is slightly below the general outer surface 126 of the second portion 112, so that a tool inserted in an aperture 127 is needed for unlocking the hook 123 from the tab 124. In FIGS. 5 to 7, locking tabs and complementary protrusions are not shown, but such features may be optionally combined with those represented on these figures.

The operations for mounting the first portion 111 and the second portion 112 of the strain-relief device 300 on the housing 500 are essentially the same as for the first embodiment. For removing the first portion 111 and the second portion 112 of the strain-relief device 300 from the housing 500, the operations are essentially the same as those already described in connection with the first embodiment, but a tool is inserted in the aperture 127 for unlocking the hook 123 from the tab 124.

In further embodiments, the strain-relief device 3, 300 may be attached not only to the housing of a connector, but also to the frame of an appliance or of a vehicle.

In further embodiments, the first portion 11, 111 and the second portion 12, 112 of the strain-relief 3, 300 may comprise sealing features in/or close to the transversal walls. For example, such sealing features may be formed by rib portions engaging complementary groove portions, so that the first portion 11, 111 and the second portion 12, 112, respectively overlap at least locally.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

The invention claimed is:

1. A connector assembly comprising:

a housing having at least one cavity for accommodating a terminal, a cable having a longitudinal axis extending along a longitudinal direction and having a conductive core electrically linked to said terminal and an outer insulative sheath, the housing comprising a rear opening through which the cable exits from the housing, a strain-relief device attached to the housing and clamping the cable in a fixed position at the rear opening, wherein the strain-relief device comprises first and second portions, each comprised of an integrally formed unitary element and being detachable from the housing, the first portion having a first arcuate surface extending over less than 360° around the longitudinal axis of the cable and having a first opening for the insertion of the cable in the strain-relief device in an insertion direction essentially perpendicular to the longitudinal axis of the cable, the first arcuate surface engaging the outer insulative sheath, and the first portion also comprising first retaining means engaging the housing for retaining the first portion on the housing, the second portion having a second arcuate surface extending over less than 360° around the longitudinal axis of the cable and having a second opening for the insertion of the cable in the strain-relief device parallel to the insertion direction, the second arcuate surface engaging the outer insulative sheath, and the second portion also comprising second retaining means engaging the housing for retaining the second portion on the housing, and a flexible locking leg extending longitudinally along the insertion direction, between a hinge located between the second arcuate surfaces, and a free end having a hook engaging a tab protruding from the housing, in a longitudinal direction of the longitudinal axis.

2. A strain-relief device configured to be mounted on the connector assembly according to claim 1, wherein the second portion is maintained on both the first portion and the housing.

3. The connector assembly according to claim 1, wherein the second portion comprises locking means for locking both the first portion and the second portion on the housing.

4. The connector assembly according to claim 3, wherein the second portion comprises at least two second side portions respectively in the form of a flexible branch extending in the insertion direction, each covering at least partially the first portion and comprising the locking means.

5. The connector assembly according to claim 3, wherein the locking means engages complementary locking means located on the first portion.

6. The connector assembly according to claim 5, wherein the locking means and the complementary locking means have respectively convex and concave surfaces, the concave surface having an apex with a tangent perpendicular to the insertion direction.

7. The connector assembly according to claim 1, wherein each one of the first portion and the second portion comprises a transversal wall that partially closes the rear opening, each transversal wall being essentially perpendicular to the longitudinal direction.

8. The connector assembly according to claim 7, wherein the first and second arcuate surfaces are supported by respective gutters extending, essentially parallel to the longitudinal direction, from a front face of each transversal wall.

9. A connector assembly comprising:

a housing having at least one cavity for accommodating a terminal, a cable having a longitudinal axis extending along a longitudinal direction and having a conductive core electrically linked to said terminal and an outer insulative sheath, the housing comprising a rear opening through which the cable exits from the housing, a strain-relief device attached to the housing and clamping the cable in a fixed position at the rear opening, wherein the strain-relief device comprises first and second portions, each comprised of an integrally formed unitary element and being detachable from the housing, the first portion having a first arcuate surface extending over less than 360° around the longitudinal axis of the cable and having a first opening for the insertion of the cable in the strain-relief device in an insertion direction essentially perpendicular to the longitudinal axis of the cable, the first arcuate surface engaging the outer insulative sheath, and the first portion also comprising first retaining means engaging the housing for retaining the first portion on the housing, the second portion having a second arcuate surface extending over less than 360° around the longitudinal axis of the cable and having a second opening for the insertion of the cable in the strain-relief device parallel to the insertion direction, the second arcuate surface engaging the outer insulative sheath, and the second portion also comprising second retaining means engaging the housing for retaining the second portion on the housing, wherein each one of the first portion and the second portion comprises a transversal wall that partially closes the rear opening, each transversal wall being essentially perpendicular to the longitudinal direction, wherein each transversal wall has a collar extending essentially parallel to the longitudinal direction, from a rear face of each transversal wall, each collar being placed against a surface of the housing, on the edge of the rear opening.

10. The connector assembly according to claim 8, wherein the gutters comprise a first gutter comprising a locking tab or a protrusion and a second gutter comprising a protrusion a locking tab or a protrusion, the respective shapes of the tab and the protrusion being complementary so as to attach the first gutter with the second gutter.

11. A method for mounting the strain-relief device with a connector assembly, comprising:

providing a connector assembly including:

a housing having at least one cavity for accommodating a terminal, a cable having a longitudinal axis extending along a longitudinal direction and having a conductive core electrically linked to said terminal and an outer insulative sheath, the housing comprising a rear opening through which the cable exits from the housing, and a strain-relief device attached to the housing and clamping the cable in a fixed position at the rear opening, wherein the strain-relief device comprises first and second portions, each comprised of an integrally formed unitary element and being detachable from the housing, the first portion having a first arcuate surface extending over less than 360° around the longitudinal axis of the cable and having a first opening for the insertion of the cable in the strain-relief device in an insertion direction essentially perpendicular to the longitudinal axis of the cable, the first arcuate surface engaging the outer insulative sheath, and the first portion also comprising first retaining means engaging the housing for retaining the first portion on the housing, and the second portion having a second arcuate surface extending over less than 360° around the longitudinal axis of the cable and having a second opening for the insertion of the cable in the strain-relief device parallel to the insertion direction, the second arcuate surface engaging the outer insulative sheath, and the second portion also comprising second retaining means engaging the housing for retaining the second portion on the housing, and a flexible locking leg extending longitudinally along the insertion direction, between a hinge located between the second arcuate surfaces, and a free end having a hook; and attaching the first portion and the second portion on the housing subsequent to the insertion of the terminal in said at least one cavity of the housing, wherein the hook engages a tab protruding from the housing in a longitudinal direction of the longitudinal axis while performing the attaching step.

* * * * *